US007128381B2

(12) United States Patent
Cheng et al.

(10) Patent No.: US 7,128,381 B2
(45) Date of Patent: Oct. 31, 2006

(54) MICROFLUIDIC INKJET CONTROL METHOD

(75) Inventors: Kevin Cheng, Hsinchu (TW); Yung-Kuo Ho, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 189 days.

(21) Appl. No.: 10/745,644

(22) Filed: Dec. 29, 2003

(65) Prior Publication Data

US 2005/0057587 A1 Mar. 17, 2005

(30) Foreign Application Priority Data

Sep. 12, 2003 (TW) ..... 92125234 A

(51) Int. Cl.
*B41J 29/38* (2006.01)

(52) U.S. Cl. ..... 347/10; 347/10; 347/5; 347/19

(58) Field of Classification Search ..... 347/5, 347/10, 19

See application file for complete search history.

(56) References Cited

U.S. PATENT DOCUMENTS 5,798,772 A 8/1998 Tachihara et al.
5,984,470 A 11/1999 Sakino et al.
6,331,039 B1 * 12/2001 Iwasaki et al. ..... 347/11
6,357,846 B1 3/2002 Kitahara
6,439,687 B1 8/2002 Inoue
6,672,697 B1 * 1/2004 Haflinger ..... 347/12
6,776,469 B1 * 8/2004 Nozawa ..... 347/14

* cited by examiner

*Primary Examiner*—Manish S. Shah
*Assistant Examiner*—Laura E Martin
(74) *Attorney, Agent, or Firm*—Birch, Stewart, Kolasch & Birch, LLP

(57) ABSTRACT

A microfluidic inkjet control method, by adjusting the driving waveform of the print head, including intercooling waveform and pre-heating waveform, to reduce the satellite droplets produced accompany the main ink droplets during the inkjet printing process. After entering the parameters, the control method uses a print head module with nozzles with adjustable rotating angle and calculates the needed nozzle sequence and appropriate time delay to control the print head module and determine the operation of each nozzle. This achieves the goal of printing different types of elements.

1 Claim, 9 Drawing Sheets

MICROFLUIDIC INKJET CONTROL METHOD

This Nonprovisional application claims priority under 35 U.S.C. § 119(a) on Patent Application No. 092125234 filed in TAIWAN on Sep. 12, 2003, the entire contents of which are hereby incorporated by reference.

BACKGROUND OF THE INVENTION

1. Field of Invention

The present invention relates to a microfluidic inkjet control method, especially a microfluidic inkjet control method that is used to adjust the inkjet waveforms of the thermal print heads.

2. Related Art

Inkjet printing technology uses precision element printing that is applicable to many different materials. It satisfies electronic industry's precision element production demands of automation, is more compact, has lower costs, has a faster production time and reduces the impact on the environment. For example: application on the color filters on the liquid crystal display panel and the organic polymer light emitter diode, PLED, production. The color filter is composed of red, green and blue colors, spread on the substrate and also the black matrixes between the color ink. The inkjet printing process is to spread the ink droplets directly on the concavities formed by the black matrixes on the color filter substrate. Different types of color filters have different color spreading patterns. Compared to the semiconductor production method for color filters, the inkjet printing equipments and production costs are dramatically decreased. The inkjet production method for the organic PLED is similar to the described color filter production method, the only difference is: the organic PLED does not need the black matrixes structure. The organic light emitting material build photoresistor banksto separate and guide the flow of different material colors.

However, the generic inkjet production method for color filters or organic PLED has a major problem caused by the satellite ink droplets that accompany the main ink droplets. If the satellite droplets are formed as ink drops break off during the drop ejection, it will follows the main drop to land on substrate, and typically, has position deviation with main drop, then makes a defect on substrate. This characteristic occurs randomly. The path of the satellite droplets usually has a slightly different angle shifted from the main ink droplets and has scattering distribution. This behavior causes serious problems, such as color mixing and low performance efficiency. At the worse case scenario, the satellite droplets can be as far away from the main droplet as 100 μm. For the stripe color filter or organic PLED, the satellite droplets have less influence in the horizontal direction, but would cause color mixing in the vertical direction. If the distance between the nozzle and the printing substrate is large, the satellite droplets can fall further away from the main droplets. The simplest solution is to move the nozzle closer to the printing substrate, so the satellite droplets are hidden within the main droplet. However, if the nozzle is too close to the printing substrate, it is easy to scratch the substrate. On the other hand, if the distance is too short, the ink drops may not be able to break-off completely, so they are dragged on the substrate; this can cause the main droplets to be shifted from the predetermined position and color mixing.

The method for solving the satellite droplet problem completely is to reduce the probability of their occurrences.

Since the density of ink increases as it is heated, the size of the ink droplet becomes inconsistent, and it may even influence the deviation straightness of the ink and make the satellite droplets problem worse. Therefore, the internal flow structure of the print head needs consist with the characteristics of the ink (viscosity coefficient and surface tension) and the surface characteristics of the nozzle material, or by changing the driving waveform of the nozzle to reduce the occurrence of the satellite drops by controlling the ink ejection condition. Such as the inkjet driving method proposed by U.S. Pat. No. 6,331,039, which divides the driving signal into two stages. The first driving signal preheats the ink and does not eject the ink. After a rest period, the second driving signal then ejects the ink. By using the first driving signal and the rest period, the ink ejection amount variation, which is changed with differential outside temperature, has been controlled.

As described in U.S. Pat. No. 6,357,846, when the nozzle is idle for a period of time, the viscosity of the ink in the nozzle near nozzle opening increases and causes the ejection of the ink drop to be unstable. The patent revealed a method to adjust the ink ejecting waveforms by adding a fine vibration to the main driving waveform. Using the fine vibration to provide the ink viscosity energy can keep the ink in a more consistent uniform condition. Input signals control the two kinds of waveforms to reduce the problem caused by the increasing viscosity of the ink droplet. The method must use two signals to control the main driving waveform and the fine vibrating waveform separately, so it is more complicated.

Since the ink droplet's ejection amount during the inkjet process is easily affected by the change in ink cartridge pressure and the environmental temperature, which affect the element's homogeneity, a more appropriate ink ejecting signal can be provided by adjusting the ink ejecting waveform or changing the driving method of the print head. As described in U.S. Pat. No. 5,798,772, modulating the pulse width can provide different heating energy. The heating energy and the voltage ratio are kept constant to improve the image quality. U.S. Pat. No. 6,439,687 provided a printing head driving method that changes the regular block driving. By using an irregular block driving sequence method it reduces the pressure variation affecting the ink cartridge, increasing the quality of the image.

Also, using the inkjet method to produce components requires very precise positioning to eject the ink droplet onto a predetermined position. Since the inkjet procedure of every type of color filter or organic PLED requires different resolutions and different types of components, they require complicated control systems and adjustment mechanics. These cause device pixel with different types or resolutions, requiring specific production equipments or printing head designs. Therefore, an efficient and simple control method to complete different types of components during the inkjet production process is a major development goal of the inkjet production technique. Like the inkjet alignment correction apparatus for color filter production described in U.S. Pat. No. 5,984,470, the to be printed color filter and the nozzle of the print head has displacements. Further, the apparatus adjusts the nozzle angle to the to be printed color filter substrate to execute inkjet printing to the color filter with the correct resolution.

However, the described print head driving method or the waveform adjustments are focused on the different specific problems and it is easy to create problems while fixing another, so an inkjet production control method needs to provide overall improvement.

SUMMARY OF THE INVENTION

To improve the known technology, the invention provides a microfluidic inkjet control method that is applicable to thermal print heads. By using the appropriate method to adjust the desired ink driving waveform, the probability of satellite droplets production is reduced.

As thermal print head's fluid drop forms, for the time period between the print head begins heating until the ink droplet is ejected, microbubbles are produced. If the time period is extended, the ink can produces more microbubbles. If enough microbubbles are formed, a stronger, more complete bubble is formed and the force that ejects the ink droplet out of the print head is also increased. The ejection character of the droplet is improved due to the increased driving energy. The invention divides the main driving waveform to more than one waveform and provides intermittent energy to increase the time period between the print head begins heating and the ink droplet is ejected. It also provides appropriate intercooling stage during the heating period to produce more complete bubble and increases the force that pushes out the ink droplet.

The microfluidic inkjet control method revealed in this invention is by adjusting the driving waveform to reduce the satellite droplets formed with the main droplet during ink ejection. The adjustment of the driving waveform is accomplished by the following steps: first, set a driving energy range that is between a lower critical driving energy and an upper critical driving energy. When the driving energy is greater than the lower critical driving energy, the print head nozzle starts ejecting ink droplets. When the driving energy is greater than the upper critical driving energy, the ink droplets ejected from the print head nozzle start to break and form incomplete scattering drops. It then provides a main driving waveform, which has driving energy between the lower critical driving energy and upper critical driving energy. Multiple time intervals with driving energy greater than 0 are added into the main driving waveform to divide the main driving waveform into more than one waveform to execute intercooling. The intercooling phase will significantly prolong the time period of forming micro-bubble and increase the stronger driving energy to push ink drop.

Also a preheating stage waveform can be added in front of the main driving waveform to increase the stability of the ink droplets injection. Preheating can help keeping each ink droplet's original shape consistent before it is injected, and also keeps the ink in the nozzle in a perturbed condition to compensate the evaporation of the ink at the nozzle surface, so ink does not solidify on the nozzle surface. To cooperate with the described microfluidic inkjet control method, more than one preheating stage waveform is added in front of the main driving waveform. The preheating stage waveform driving energy is lower than the lower critical driving energy, so the ink droplets are not ejected. This achieves the goal of preheating the ink and reduces the chance of ink kogation.

The invention also includes another goal; by controlling the nozzle printing sequence and the nozzle printing time delay, it can control the needed element type of the picture. As described in the previous case, to print device pixels of different resolution, the angle of the nozzle to the ink ejecting substrate can be adjusted to execute appropriate inkjet printing according to the device pixel resolution. The inkjet system adjusts the nozzle rotating angle to fit the pitch of pixel. The microfluidic inkjet control method of the invention also provides a simple inkjet printing module that corresponds with the print head module with the adjustable nozzle rotating angle. By directly input the parameters into the control module, the needed sequence and time delay can be calculated and used to control the print head module to determine the operation of each nozzle. By simple parameter manipulation, printing different types of component pictures can be achieved.

The invention cooperates with the print head module with nozzles, with adjustable rotating angle, and calculates the input printing parameter by the control- processing unit. So the printing sequence of each nozzle head and the printing time differences between the nozzles is computed. The values are then transferred to the control module to control the print head module to determine the operation of each nozzle. The procedure includes the following: first, input the printing component parameters to the central processing unit; the central processing unit calculates the printing sequence of each nozzle head and the printing time differences between each nozzle and defines the sequence table and the time delay table; finally, the control module controls the print head module and prints according to the sequence table, the time delay table, and a driving waveform. When printing different types of device pixels, it is done according to the different printing component parameters. The printing component parameters include: matrix width, front non-printing spacing width (the distance between the reference point to the first printing color block), distance between ink droplets in the same print block, distance between the ink droplets in two neighboring blocks, and the width of the printing block.

The sequence table definition needs to use a reference nozzle position first, to relate the order of the nozzles. The order between each nozzle is determined by the reference nozzle position and the inkjet printing position. The time delay table determines the time difference between the printing time of the nozzles, and the print head module can be delayed by the rotations of the print heads.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and is thus not limitative of the present invention, wherein.

DETAILED DESCRIPTION OF THE INVENTION

The invention adjusts the driving waveform, to reduce the satellite droplets, accompanying the main droplet during the ink ejecting process. When ink is heated at the nozzle, microbubbles appear; at this time, extending the time period between the heating and the ejecting of the ink, and intercooling stages are inserted. The intercooling stages can extend the time period between heating and ejecting of the ink, so that more microbubbles are produced constructing more complete and stronger bubbles and increasing the force that ejects the ink droplets out of the nozzle. The ejecting property of the ink droplet is improved as the ejection velocity is increased and the flying deviation of the ink droplet is decreased, so the satellite droplets are reduced. A preheating stage waveform, which increases the stability of the ink ejection, is also inserted before the main driving waveform. Preheating can keep the shape of the original shapes of the ink droplets consistent before they are ejected and also keep the ink in the nozzle in liquid state to compensate for the ink evaporation on the nozzle surface. Since the ink evaporation can increase the solidification of the ink on the nozzle surface, the preheating stage waveform, which is ½ to 1/20 the size of the main waveform, is added in front of the main driving waveform to reduce the evaporation. The size of the preheating waveform and the intervals can be obtained from experiments.

Figure 1:
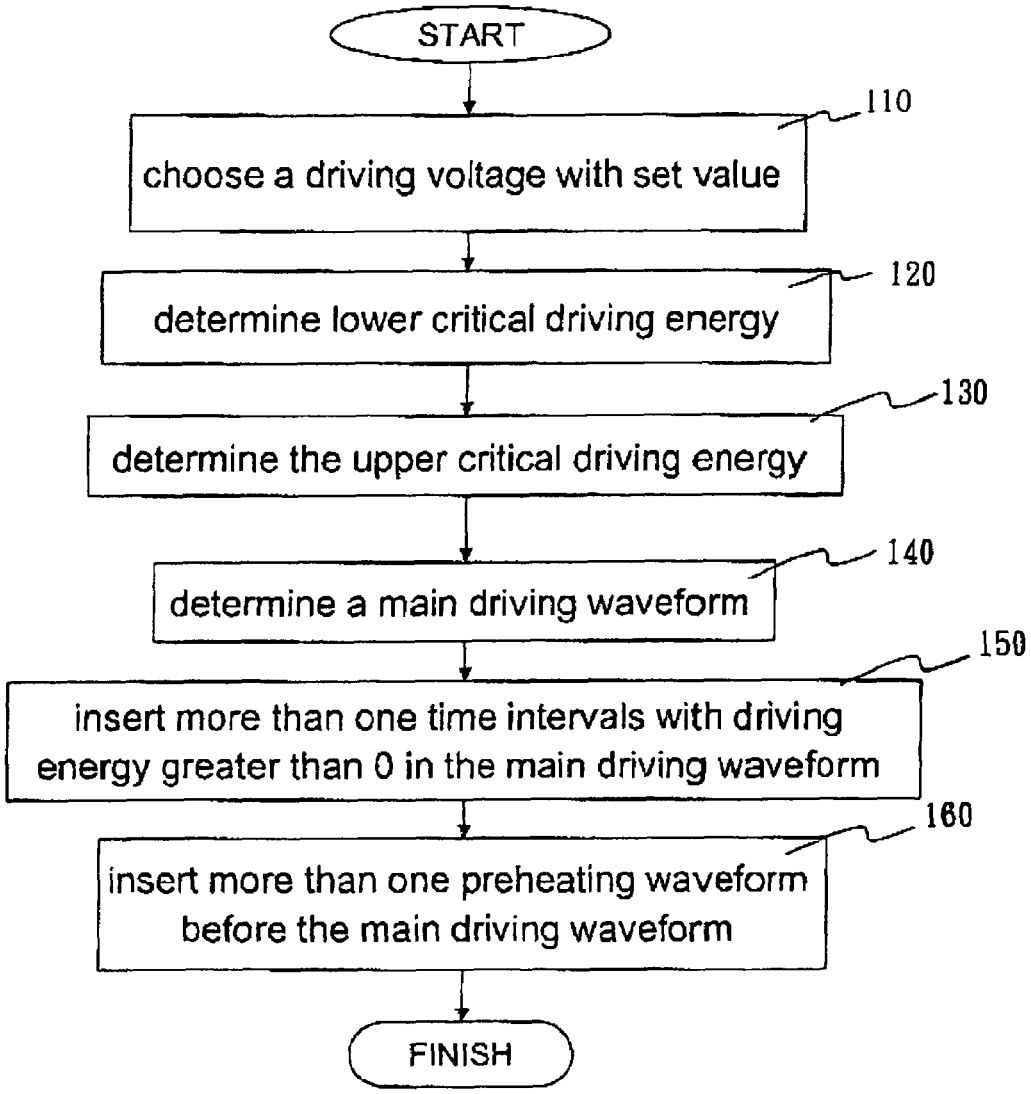
FIG. 1 illustrates, in flow diagram, the driving waveform adjustment procedure of the invention.

The microfluidic inkjet control method decreases the occurrence of the satellite droplets by adjusting the driving waveform. Please refer to FIG. 1 for the illustration of the flow diagram of the adjustments of the driving waveform in the invention. First, choose a driving voltage with set value (step 110); determine the lower critical driving energy (step 120), which is the smallest driving waveform width, when greater than the lower critical driving energy, the nozzle ejects ink droplets; determine the upper critical driving energy (step 130), which is the largest driving waveform width, when greater than the upper driving energy, the ink droplets ejected by the nozzle start to break and they are incomplete; determine a main driving waveform (step 140), which has driving energy between the lower and upper critical driving energy; insert more than one time intervals with driving energy greater than 0 in the main driving waveform, which divides the main driving waveform into more than one waveform to execute intercooling; insert more than one preheating waveform before the main driving waveform (step 160), and the driving energy of the preheating waveform is smaller than the lower critical driving energy.

Figure 2:
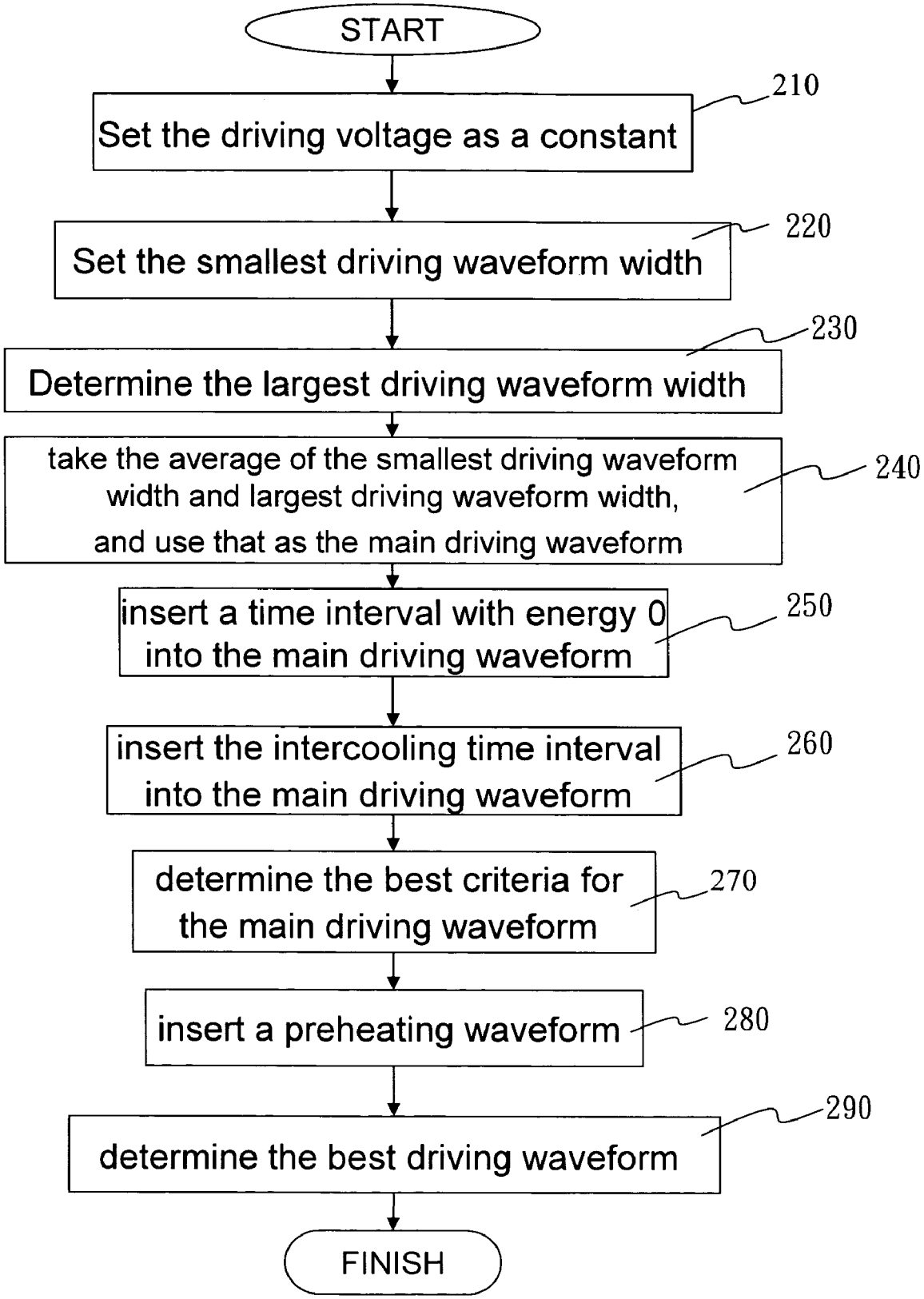
FIG. 2 illustrates, in flow diagram, the driving waveform criteria determining procedure of the invention.

The main driving waveform, time intervals with driving energy equals to 0 and the preheating waveform together form the ink driving waveform, and they can obtain the best criteria with the following steps. Please refer to FIG. 2 for the flow diagram of the driving waveform's criteria setting in the invention:

Set the driving voltage as a constant (step 210), the example in the invention uses 18 volts. Set the smallest driving waveform width (step 220), which is determined by observing the smallest energy that is required to eject a complete ink drop, which is 3 μs and 18 volts (time, voltage). Determine the largest driving waveform width (step 230) that is based on the energy that causes ink drops to diverging or scattering distribution, in this case which is 7 μs and 18 volts (time, voltage). Take the average of the smallest driving waveform width and largest driving waveform width, and use that as the main driving waveform (step 240), which is 5 μs and 18 volts (time, voltage). Insert a time interval with energy 0 into the main driving waveform (step 250) to divide the main driving waveform into more than one waveform to execute intercooling. The driving waveform energy is spread in (2 μs、18V), (0.2 μs、0V), (2.8 μs、18V), which is a total of 5 μs; or insert the intercooling time interval into the main driving waveform (step 260), so the driving waveform energy spread is (2 μs、18V), (0.2 μs、0V), (3 μs、18V), which is a total of 5.2 μs. The intercooling phase will significantly prolong the time period of forming microbubble and increase the stronger driving energy to push ink drop. Determine the best criteria for the main driving waveform (step 270), and the spread of the driving waveform of the example for the invention is (2 μs、18V), (0.4 μs、0V), (2.8 μs、18V), which is a total of 5.4 μs. Insert a preheating waveform (step 280), so the driving waveform energy spread is (2 μs、18V), (0.4 μs、0V), (3 μs、18V), which is a total of 5.4 μs. Finally, determine the best driving waveform (step 290) , and the energy spread is (0.1 μs、18V), (0.1 μs、0V), (0.1 μs、18V), (0.1 μs、0V), (2 μs、18V), (2 μs、18V), (0.4 μs、0V), (3μs、18V), which is a total of 5.8 μs. Driving pulses of step 210 to step 290 are shown in Table 1.

TABLE 1

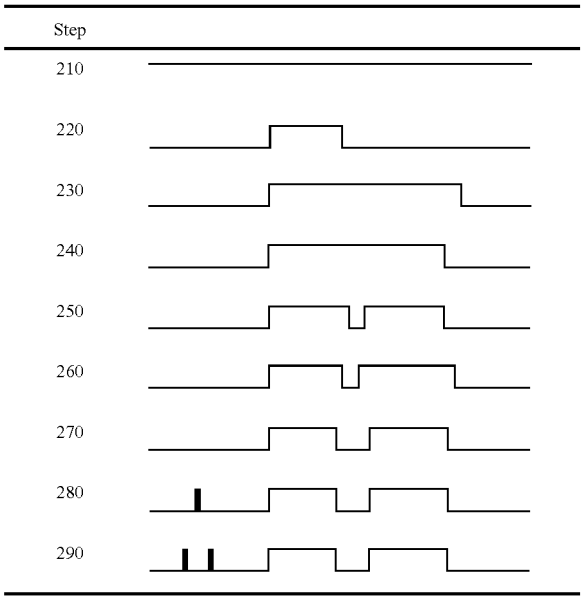

Figure 7A:
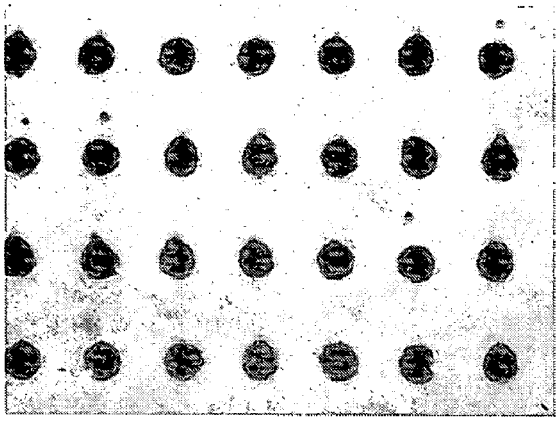
FIG. 7A to 7C are pictures of different driving waveform's ink ejection results.
Figure 7B:
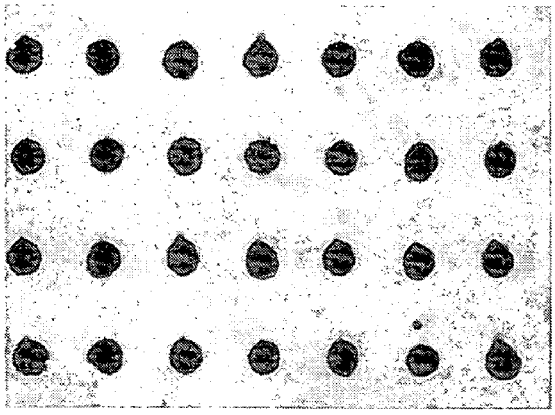
Figure 7C:
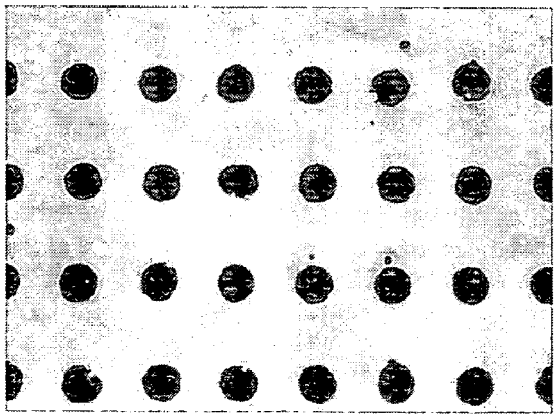

Please refer to FIG. 7A to FIG. 7C, which have the pictures of the ink droplets ejections resulting from using different driving waveforms. As shown in FIG. 7A, the original driving waveform produces satellite ink droplets, and the shape of the ejected ink droplet is uneven. As shown in FIG. 7B, the result of the ink droplet ejection using intercooling waveforms indicates visibly less satellite droplets. As shown in FIG. 7C, which is the result of the ink droplets ejection using preheating waveforms combined with the intercooling waveform, the satellite droplets are decreased and the shapes of the droplets is uniform. This shows that the adjustment of the waveforms can visibly improve the print quality.

Figure 3:
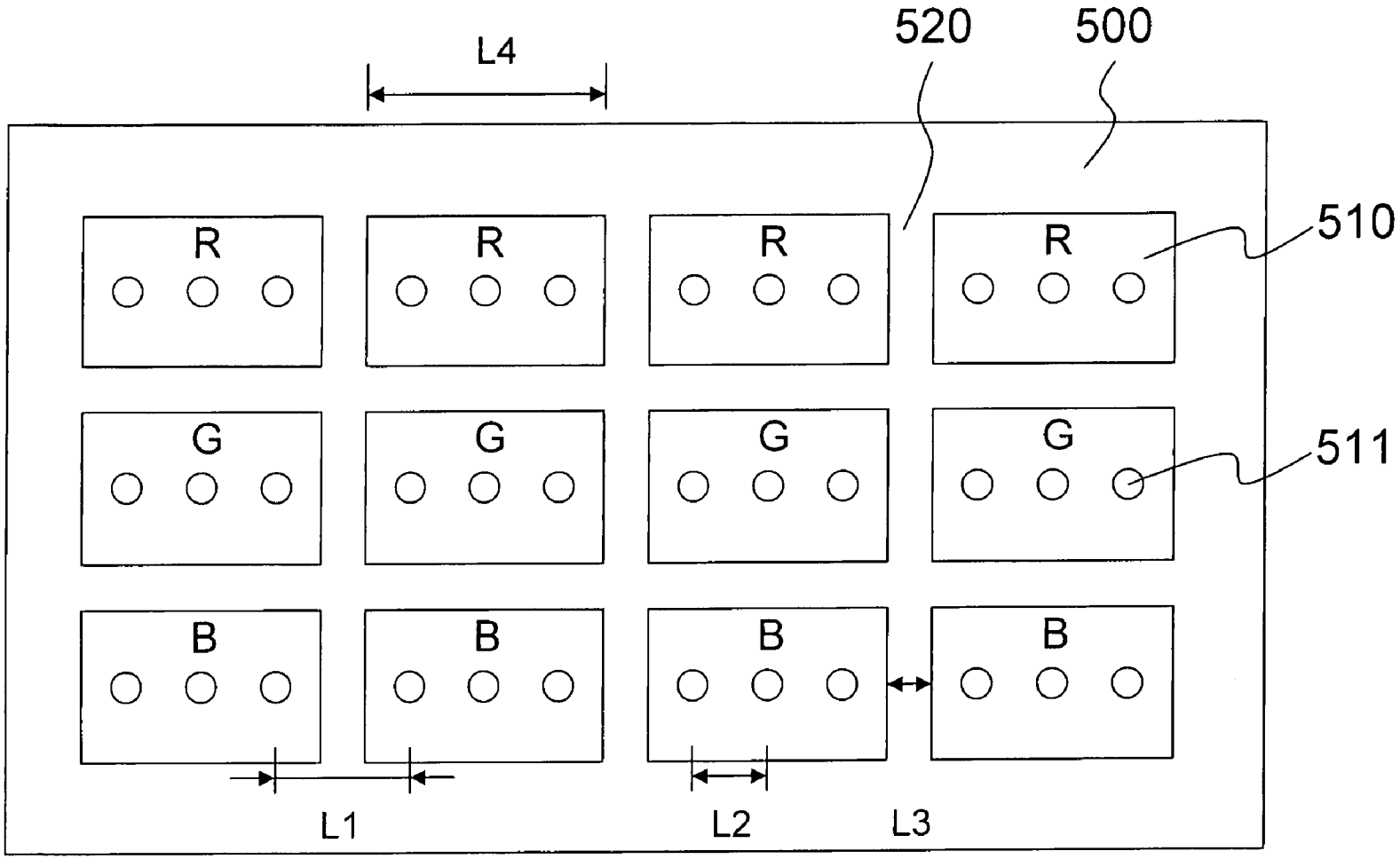
FIG. 3 illustrates a stripe filter diagram.
Figure 4:
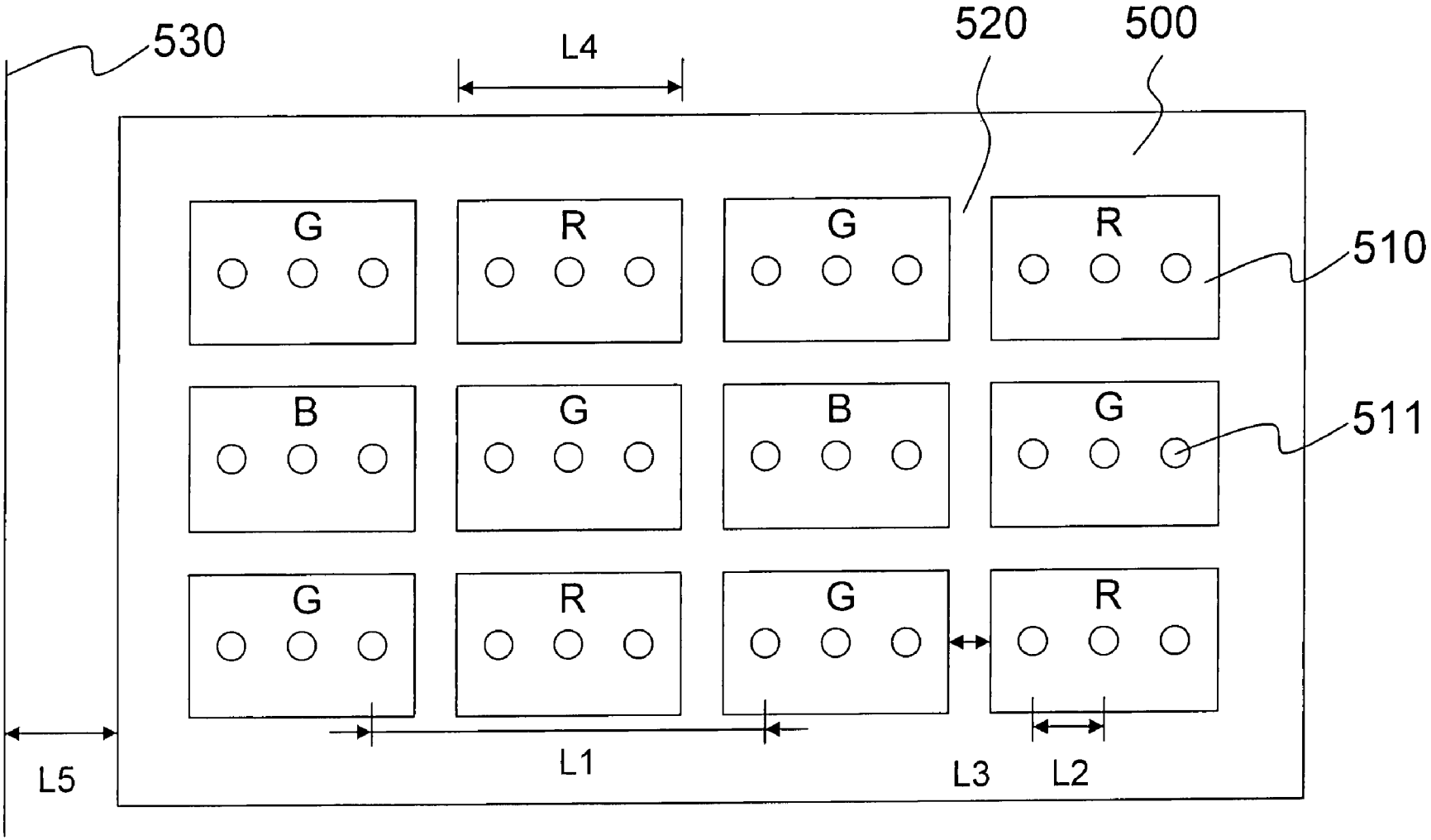
FIG. 4 illustrates a mosaic filter diagram.

The invention cooperates with the print head module with nozzles with adjustable rotating angles, and uses different input printing parameters to produce different types of components. The printing element parameters include: matrix width, front non-printing spacing width (the distance between the reference point to the first printing color block), distance between ink droplets in the same print block, distance between the ink droplets in two neighboring blocks, and the width of the printing block. The described printing parameters can be set using the sequence table and the time delay table. The two usual types of device pixels are stripes and mosaic; the invention provides a method applicable to both types by entering different parameters for stripe and mosaic, so no hardware design change is required. Please refer to FIG. 3 for the stripe device pixel illustration and FIG. 4 for the mosaic component picture illustration. As shown in FIGS. 3 and 4, the printing is done on the ink ejection spot 511 on the substrate 500 with the black matrixes 520 to form RGB tricolor printing color blocks 510. The printing parameter includes: distance L1 between the ink droplets in two neighboring blocks 510, distance L2 between ink droplets in the same print block 510, width of the matrix L3, width of the printing block L4, and front non-printing spacing width L5, which is the distance between the reference point 530 to the first printing color block 510.

Since the nozzles in the print head module are not lined up in a straight line, the invention defines a sequence table, which selects the nozzles used for printing and adds in the order of sequence for the nozzles. The time delay table is a table for the time delays between adjacent nozzle's printing sequences. By controlling the sequence of the nozzles and the time delay, the appropriate printing format can be set for each printing parameter.

When the space between the component picture's resolution and the space between the print head nozzles are different, the print head can rotate to a different angle and change the ink ejection angle to print component pictures of different resolution. The relationship formulas are the following:

Printing speed: v

Reference to nozzle coordinates: $(x_0,y_0)$

The nth nozzle coordinates: $(x_n,y_n)$

The original nozzle angle: $\theta_0=\tan^{-1}((x_n-x_0)/(y_n-y_0))$

Nozzle rotating angle: $\theta$

Distance between two neighboring nozzles: $L_n=((x_n-x_0)^2+(y_n-y_0)^2)^{0.5}$

The delay time for the nth nozzle: $x_n/v=(L_n*\sin(\theta_0+\theta))/v$

The delay time corresponding to the other nozzles can be derived from the above formulas, and the drop positions of the ink droplets are changed as the nozzle angle changes.

Figure 8:
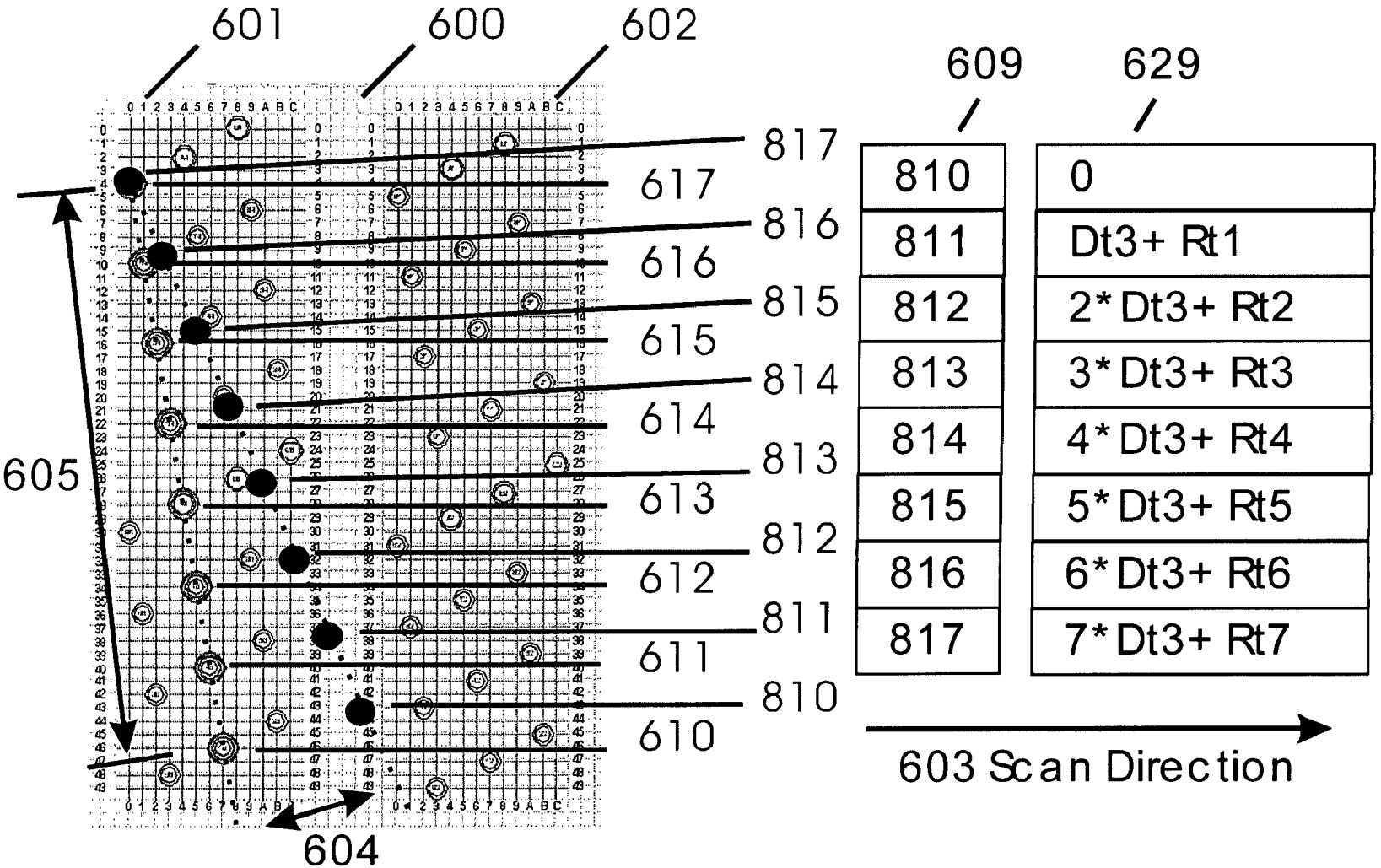
FIG. 8 is a nozzle selection, sequence table, and time delay table.
Figure 9:
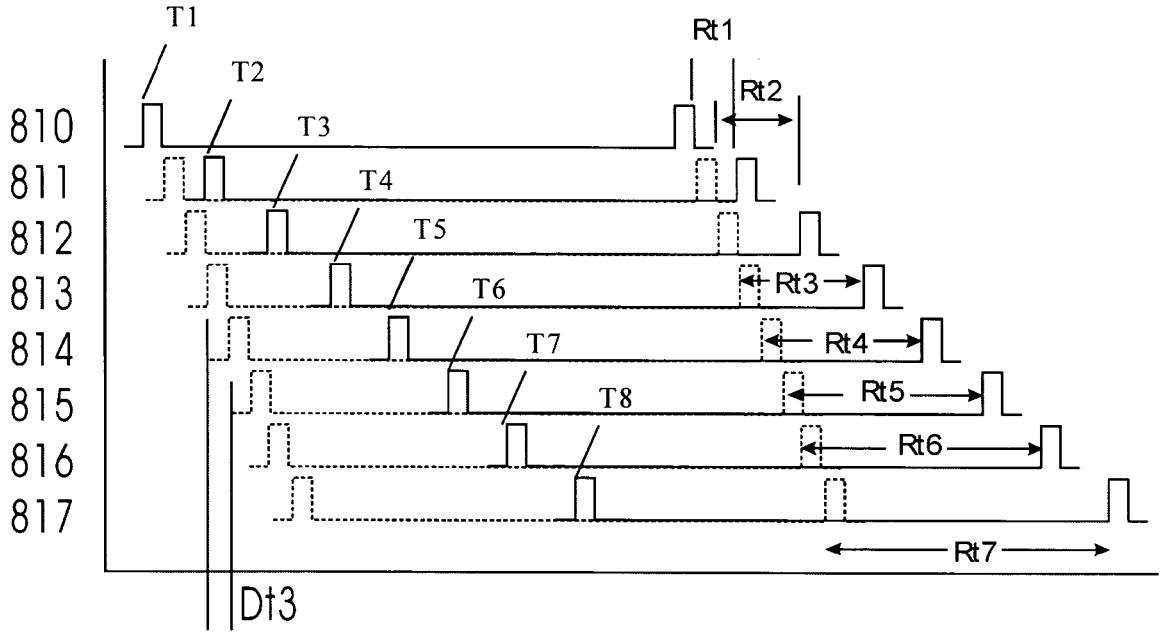
FIG. 9 is the driving waveform delay diagram for each nozzle.

Please refer to FIG. 8, which illustrates the nozzle selection, sequence table and the time delay table for the following example for the invention. There are two nozzle areas 601 and 602, and they are separated by interval 600. Select sequence 605 and the 8 nozzles 610 to 617 as the printing nozzles. After the rotating angle changes, the sequence becomes 604, including nozzles 810 to 817. The printing direction 603 indicated by the arrow, and the sequence shown by print sequence table 609. After the first nozzle 810 has ejected ink, one nozzle position is delayed by time Dt3 and the nozzle rotating position is delayed by time Rt1, then the second nozzle 811 ejects ink to obtain a perpendicular straight line. Different nozzles have different corresponding rotating angle differential times Rt1~Rt7, and different delay times, as shown in the time delay table 629 in FIG. 8. Since nozzle 810 is the first nozzle to start ejecting ink, the time delay is 0, nozzle 811 is delayed by (Dt3+Rt1), and nozzle 812 needs to be delayed by (2*Dt3+Rt2); time delay table 629 is obtained using this method. By working with the sequence table and time delay table, the driving waveform delay for each nozzle is determined, as shown in FIG. 9. Nozzles 810~817 are ordered according to the sequence table, using the time delay table, so that after the first nozzle 810 has printed time Dt2 is delayed, then the second nozzle 811 prints, and finishes the selected nozzles in order.

Figure 5:
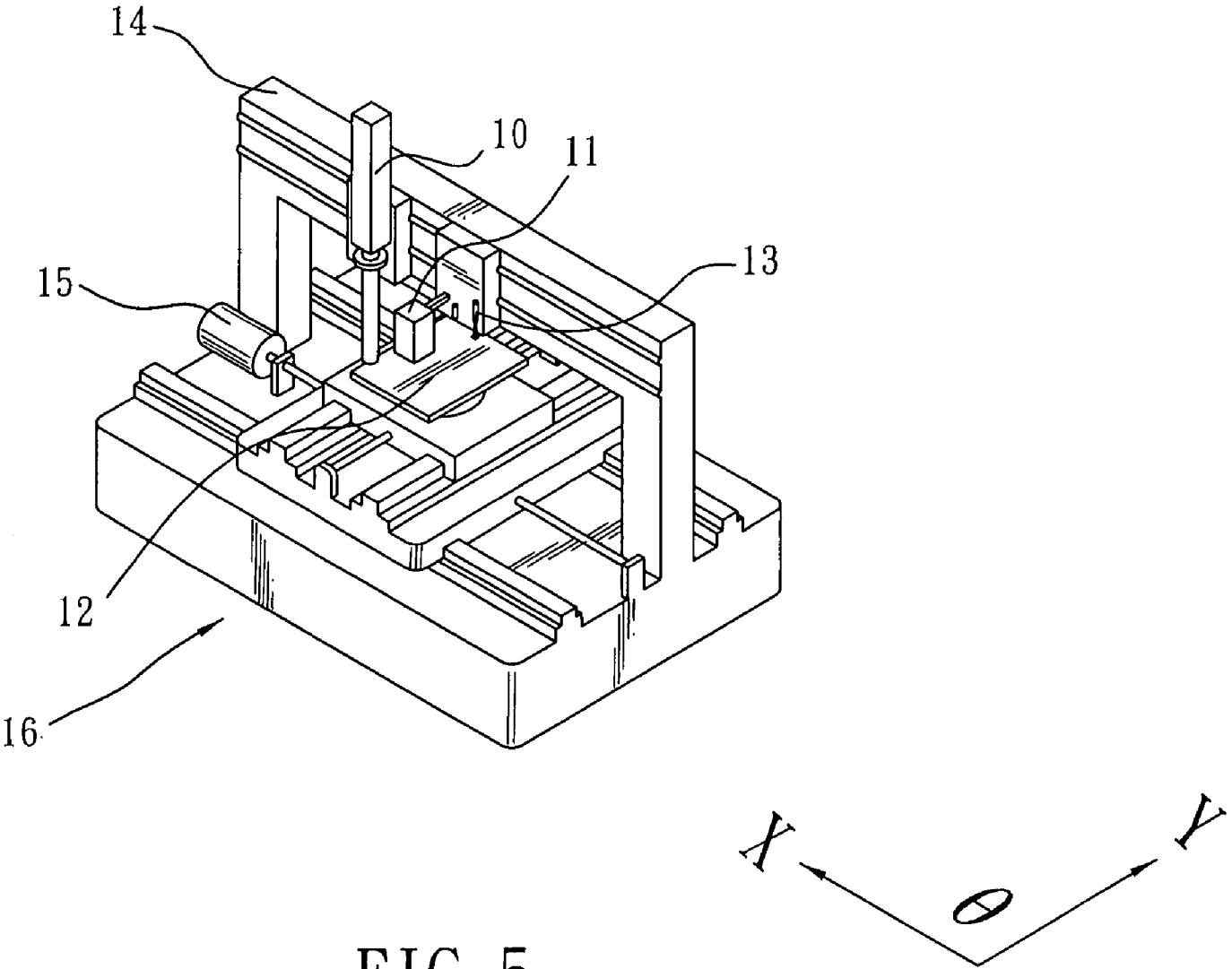
FIG. 5 illustrates an inkjet equipment diagram.

Therefore, the invention can be applied to the different production method device pixels. As shown in FIG. 5, this illustrates the inkjet equipment. It comprises of a print head module 11, a mobile platform 16, an optical detecting module and a control module. The print head module 11 has at least one nozzle-hole, and every color has a separate print head (usually the basic three colors, red, green, and blue) to eject ink droplets to the substrate 12. The mobile platform 16 can support substrate 12 for the print head module 11 to spread ink droplets. It also has supporting frames 14 to set up the print head module 11, and uses a driving motor 15 to allow X-Y$\theta$ tri-directional movement for the print head module 11.

The optical detecting module includes an area CCD 13 and a linear CCD 10, used to detect the relative position of the substrate 12 and nozzle-hole of print head module 11. Area CCD 13 is used to detect the position of substrate 12. The linear CCD 10 detects the relative shifted position between print head module's 11 nozzle-hole and the ink-printing track. The area CCD 13 provides the initial position correction and the linear CCD 10 provides instant positioning and precision positioning. The described inkjet equipment is also connected to a central processing unit (not shown in the picture) to control each module unit's operation. The central processing unit connects with a user interface (not shown in the picture) to allow user input print element parameters and transmit them to the control module.

Figure 6:
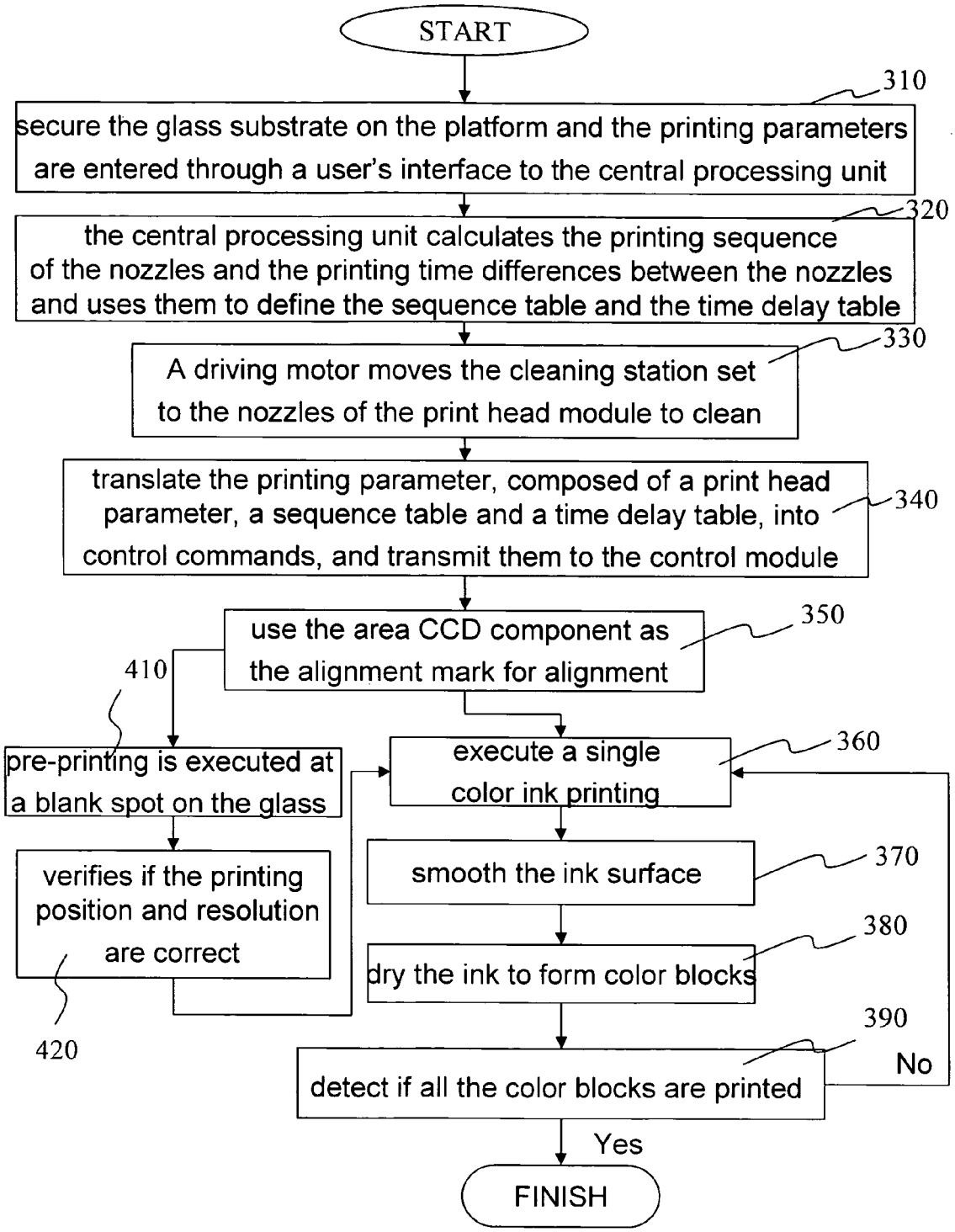
FIG. 6 illustrates, in flow diagram, the inkjet production method for manufacturing a color filter or an organic PLED components diagram.

The invention reveals a microfluidic inkjet control method that works with the described equipment, as shown in FIG. 6, the flow diagram for producing color filter or organic PLED production using inkjet method. First, secure the glass substrate on the platform and the printing parameters are entered through a user's interface to the central processing unit (step 310), the print nozzle parameters are also determined; the central processing unit calculates the printing sequence of the nozzles and the printing time differences between the nozzles and uses them to define the sequence table and the time delay table (step 320). A driving motor moves the cleaning station set to the nozzles of the print head module to clean (step 330); translate the printing parameter, composed of a print head parameter, a sequence table and a time delay table, into control commands, and transmit them to the control module (step 340), through the X-Y-$\theta$ platform adjustments to align the glass substrate and set this position as the original position; use the area CCD component as the alignment mark for alignment (step 350); execute a single color ink printing (step 360); smooth the ink surface (step 370); then dry the ink to form color blocks (step 380); detect if all the color blocks are printed (step 390). If not: repeat, starting from step 360, to continue executing other color ink printing; if so, the device pixel production is finished.

Also, before executing a single color ink printing (step 360), a pre-printing operation can be used to test if the printing position is correct. Pre-printing is executed at a blank spot on the glass (step 410) and verifies if the printing position and resolution are correct (step 420). It not, repeat step 350 and further, to arrive at a correct position.

Knowing the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A microfluidic inkjet control method, by adjusting driving waveform of a print head to increase stability and reduce satellite drop occurrence of ejected ink droplets from said print head, the method comprising the steps of:

setting a driving energy, which is between a lower critical driving energy and an upper critical driving energy, when the driving energy applied to said print head is greater than the lower critical driving energy, the ink droplets are ejected, when the driving energy applied to the print head is greater than the upper critical driving energy, the ink droplets ejected from said nozzle start to break and become incomplete;

providing more than one preheating waveform, the driving energy of the preheating waveforms being less than the lower critical driving energy;

providing a main driving waveform, driving energy of said main driving waveform is between said lower critical driving energy and said upper critical driving energy, the driving energy of the preheating waveforms ranging from ½ to 1/20 of the driving energy of the main driving waveform; and inserting more than one time intervals with driving energy greater or equal than 0 that divides said main driving waveform into more than one waveforms to execute intercooling.

* * * * *